US011629851B2

(12) United States Patent
Pan et al.

(10) Patent No.: US 11,629,851 B2
(45) Date of Patent: Apr. 18, 2023

(54) MULTI-BUTTON LAMP POWER SUPPLY OR CONTROLLER

(71) Applicant: Changzhou Jutai Electronic Co., Ltd., Changzhou (CN)

(72) Inventors: Chengqian Pan, Zhangzhou (CN); Wei Huang, Changzhou (CN); Jun Lin, Changzhou (CN); Bin Chen, Changzhou (CN)

(73) Assignee: Changzhou Jutai Electronic Co., Ltd., Changzhou (CN)

( * ) Notice: Subject to any disclaimer, the term of this patent is extended or adjusted under 35 U.S.C. 154(b) by 223 days.

(21) Appl. No.: 16/845,475

(22) Filed: Apr. 10, 2020

(65) Prior Publication Data

US 2021/0148556 A1 May 20, 2021

(30) Foreign Application Priority Data

Nov. 19, 2019 (CN) ..... 201921994422.X

(51) Int. Cl.

| | |
|---|---|
| ***F21V 23/04*** | (2006.01) |
| ***H01H 13/06*** | (2006.01) |
| ***H01H 13/14*** | (2006.01) |
| ***H05B 47/10*** | (2020.01) |

(52) U.S. Cl.
CPC ..... *F21V 23/04* (2013.01); *H01H 13/06* (2013.01); *H01H 13/14* (2013.01)

(58) Field of Classification Search
CPC ..... F21V 23/04; H01H 13/06; H01H 13/14
See application file for complete search history.

(56) References Cited

U.S. PATENT DOCUMENTS

2007/0159009 A1* 7/2007 Bayat ..... H05B 47/185 307/143
2017/0135166 A1* 5/2017 Huang ..... H01H 13/06

* cited by examiner

*Primary Examiner* — Wei (Victor) Y Chan
(74) *Attorney, Agent, or Firm* — Bayramoglu Law Offices LLC

(57) ABSTRACT

A multi-button lamp power supply or controller, comprising a shell and a circuit board arranged in the shell, and further comprising: a first mode switching component, wherein one end of the first mode switching component fits with the shell, and the other end of the first mode switching component is positioned inside the shell and fits with the circuit board; and a second mode switching component, wherein one end of the second mode switching component fits with the shell, and the other end of the second mode switching component is positioned inside the shell and fits with the circuit board. The utility model has the advantages of simple operation.

9 Claims, 18 Drawing Sheets

MULTI-BUTTON LAMP POWER SUPPLY OR CONTROLLER

CROSS REFERENCE TO THE RELATED APPLICATIONS

This application is based upon and claims priority from Chinese Patent Application 201921994422.X, filed on Nov. 19, 2019, the entire contents of which are incorporated herein by reference.

TECHNICAL FIELD

The utility model relates to a multi-button lamp power supply or controller.

BACKGROUND

LED string lights or tape lights are generally connected with a driving power supply; the driving power supply includes a shell, a circuit board and a key; and the circuit board generates a control signal by pressing the key to change the flash modes of LED string lights or tape lights, thereby achieving different flash effects. However, as only one key is arranged on the driving power supply in the prior art, only flash effects can be operated.

As for the LED light, after the lamp power supply (i.e., a power supply processing circuit and a control circuit are integrated on a same circuit board) or a controller (i.e., an independent controller, refers to that only the control circuit is arranged on the circuit board, and the power supply required by the controller is supplied by an external power supply processing circuit) in the prior art is connected with the LED light, changing the flash modes while changing the emitting colors, timing, dimming and the like of the lamp cannot achieved with one key.

SUMMARY

The utility model provides a multi-button lamp power supply or controller, which is convenient to operate.

The technical solution of solving the technical problem is as below:

A multi-button lamp power supply or controller includes a shell and a circuit board arranged in the shell, and further includes:

a first mode switching component, wherein one end of the first mode switching component fits with the shell, and the other end of the first mode switching component is positioned inside the shell and fits with the circuit board; and a second mode switching component, wherein one end of the second mode switching component fits with the shell, and the other end of the second mode switching component is positioned inside the shell and fits with the circuit board.

According to the utility model, through a plurality of mode switching components, a user can conduct operations on the flash modes, emitting colors, timing, dimming and the like of lamps according to needs. For example, two mode switching components are arranged, one is used to switch the flash modes, and the other is used to switch the emitting colors; or one is used to switch the flash modes, and the other is used to switch timing; or one is used to switch the flash modes, and the other is used to switch dimming; or one is used to switch the emitting colors, and the other is used to switch timing. The utility model has other functions, and has the advantage of convenient operation.

LIST OF REFERENCE NUMERALS

Figure 1:
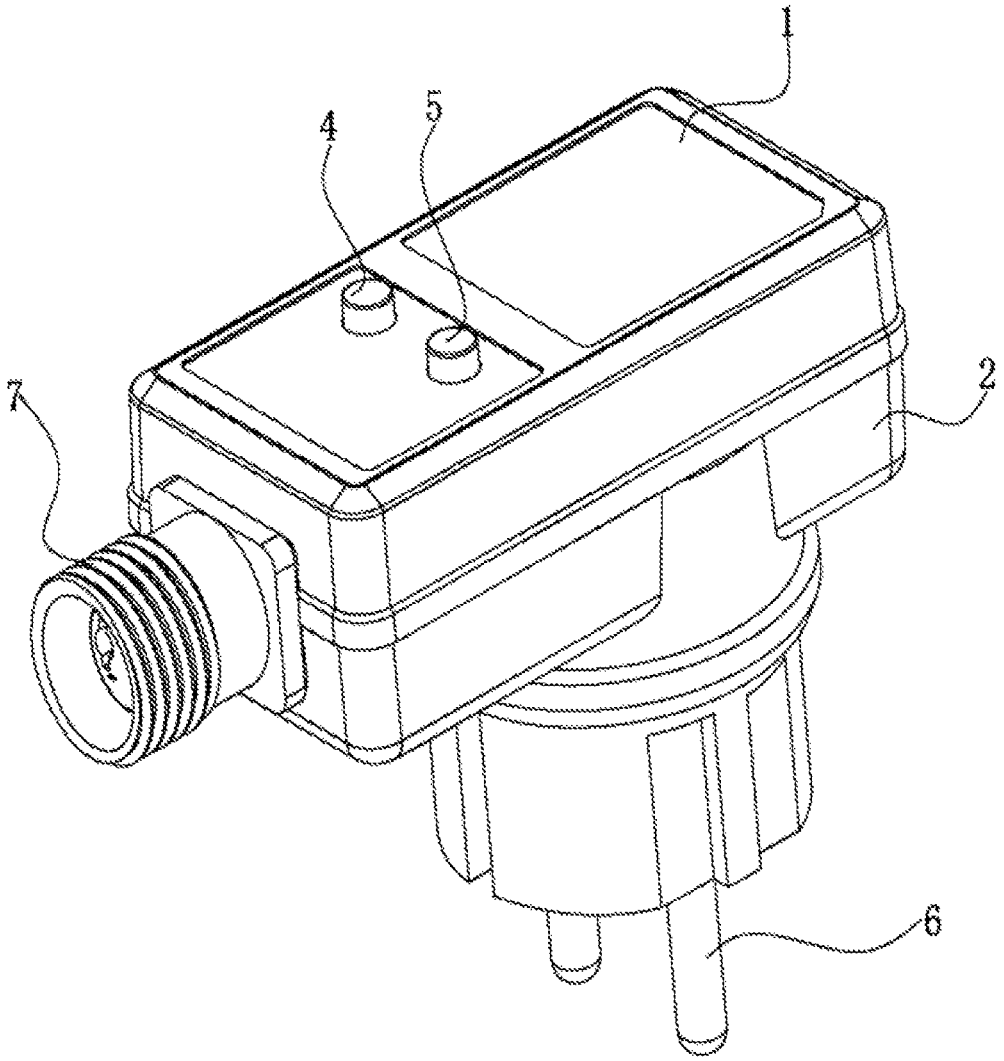
FIG. 1 is a schematic three-dimensional structure diagram of a first multi button lamp power supply.

1—Upper shell, 1*a*—Straight hole section, 1*b*—Tapered hole section, 1*c*—First annular accommodating part, 1*d*—Second annular accommodating part, 2—Lower shell, 3—Circuit board, 4—First mode switching component, 5—Second mode switching component, 6—Input end, 7—Output end, 8—Pressing part, 9—Deformation part, 10—Support part, 10*a*—Through hole, 11—Conducting part and 12—Exhaust slot.

DETAILED DESCRIPTION OF THE EMBODIMENTS

Embodiment 1

As shown in FIG. 1 to FIG. 5, a first multi-button lamp power supply according to the utility model is a horizontal lamp power supply, an input end 6 and an output end 7 are arranged on a shell 1, respectively, and the input end 6 is perpendicular to the output end 7 in an axial direction.

The lamp power supply includes a shell and a circuit board 3, a first mode switching component 4 and a second mode switching component 5 which are arranged in the shell. Each part and a relationship therebetween are illustrated in detail below.

Figure 2:
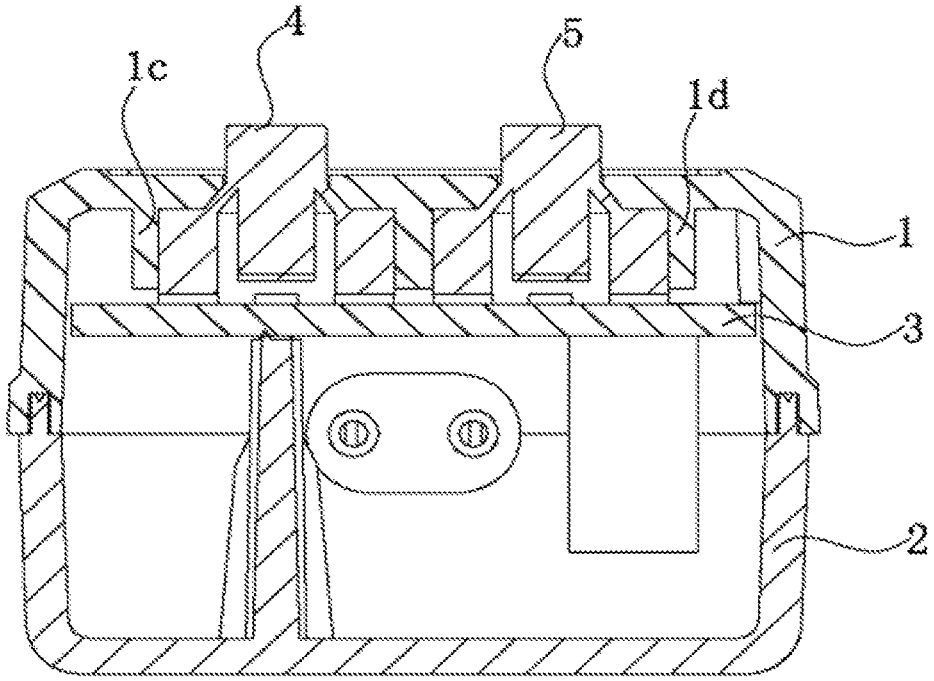
FIG. 2 is a cross-sectional structure diagram of FIG. 1.
Figure 3:
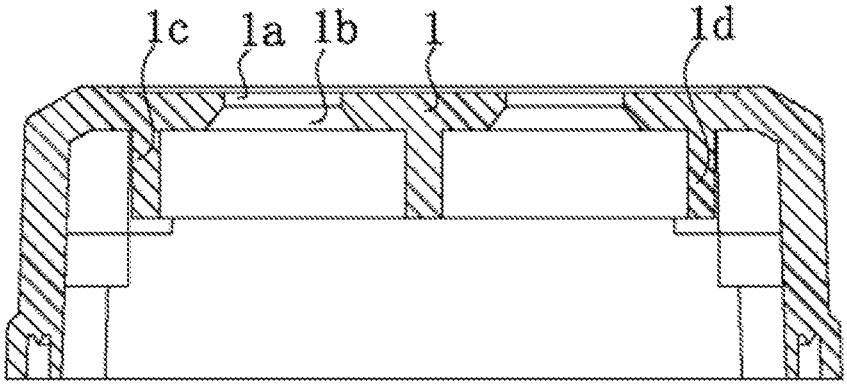
FIG. 3 is a schematic cross-sectional structure diagram of an upper shell.

As shown in FIG. 2 and FIG. 3, in the present embodiment, the shell includes an upper shell 1 and a lower shell 2 fixed to the upper shell 1; a first through hole and a second through hole are formed in the upper shell 1, preferably, the first through hole and the second through hole are each composed of a straight hole section 1*a* and a tapered hole section 1*b*. One end of the first mode switching component 4 fits with the shell, and the other end of the first mode switching component 4 is positioned inside the shell and fits with the circuit board; and one end of the second mode switching component 5 fits with the shell, and the other end of the second mode switching component 5 is positioned inside the shell and fits with the circuit board 3. Preferably, one end of the first mode switching component 4 passes through the first through hole and is exposed outside the shell, and one end of the second mode switching component 5 passes through the second through hole and is exposed outside the shell.

As shown in FIG. 2 and FIG. 3, a first annular accommodating part 1*c* and a second annular accommodating part 1*d* are arranged on an inner surface of the upper shell 1 that faces the lower shell; the first annular accommodating part 1*c* is positioned around the first through hole, and the second annular accommodating part 1*d* is positioned around the second through hole; and one part of the first mode switching component 4 fits in the first annular accommodating part 1*c*, and one part of the second mode switching component fits in the second annular accommodating part 5.

As shown in FIG. 2 and FIG. 3, the input end 6 and the output end 7 are electrically connected with the circuit board, respectively. The input end 6 is a conductive pin and is connected with mains supply; the alternating current is converted into direct current through the circuit board 3, and then the direct current is outputted to the output end 7; and a load lamp is connected with the output end 7 to obtain the power supply required for operation, and operates according to a control signal outputted by a controller arranged on the circuit board.

As shown in FIG. 1 and FIG. 2, the other end of the first mode switching component is positioned inside the shell and fits with the circuit board 3. The other end of the second mode switching component is positioned inside the shell and fits with the circuit board 3.

As shown in FIG. 1 and FIG. 2, the first mode switching component 4 and the second mode switching component 5 fit with the circuit board 3 respectively to change the flash modes, emitting colors, timing, dimming and the like of the lamp. As for the flash modes, a corresponding control program is set in the controller on the circuit board to control the flicker frequency of the lamp, such as a plurality of lighting effects that are disclosed in CN203523098U. By controlling the first mode switching component 4 or the second mode switching component 5, switching can be achieved between multiple preset flash modes, thereby selecting the required lighting effect. As for the emitting colors, the lamp is controlled to generate different colors. As for changing the colors of the RGB lamp, switching between multiple preset emitting colors can be achieved by controlling the first mode switching component 4 or the second mode switching component 5, thereby selecting the required emitting color. As for timing modes, for example, keeping ON for 6 hours and OFF for 18 hours, or keeping ON for 8 hours and OFF for 16 hours within set time, switching can be achieved between multiple preset timing modes by controlling the first mode switching component 4 or the second mode switching component 5, thereby selecting the required timing mode. Dimming refers to adjusting the brightness of the lamp, i.e., with a given signal and a preset program, changing the brightness each time the signal is given, and repeating this cycle.

As shown in FIG. 1 and FIG. 2, there is no duplication between the functions of the first mode switching component 4 and the functions of the second mode switching component 5. For example, when the first mode switching component 4 is used to switch the flash modes, the second mode switching component 5 is used to switch the emitting colors or timing; and when the first mode switching component 4 is used to switch the emitting colors or timing, the second mode switching component 5 is used to switch the flash modes.

Figure 4:
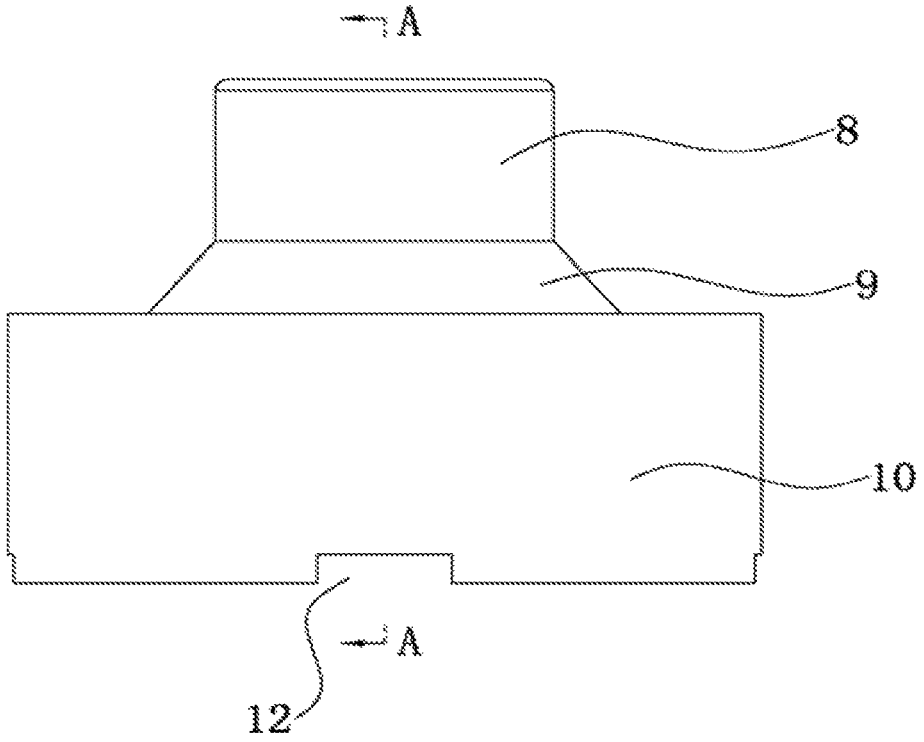
FIG. 4 is a schematic diagram of a first mode switching component or a second mode switching component.
Figure 5:
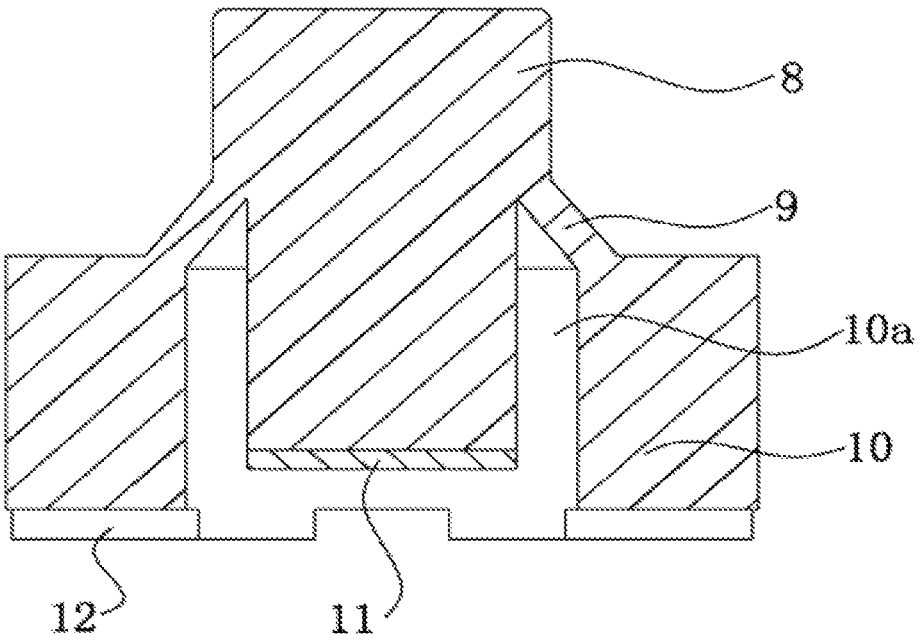
FIG. 5 is a cross-sectional view along line A-A in FIG. 4.
Figure 6:
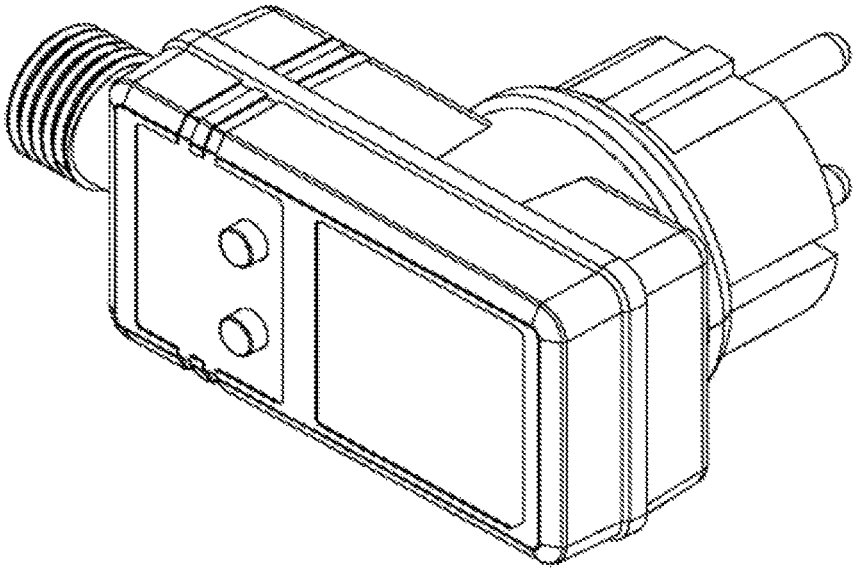
FIG. 6 to FIG. 15 are schematic diagrams of appearances of various first multi-button lamp power supplies.
Figure 7:
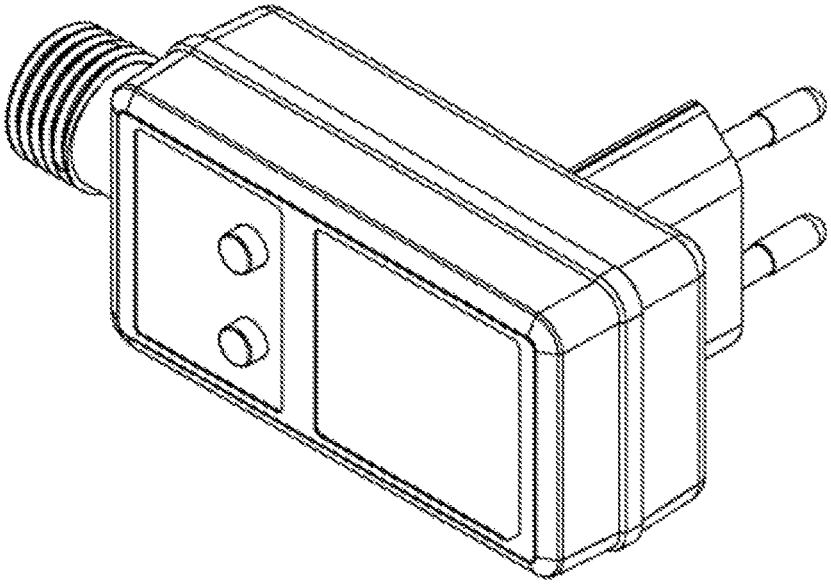
Figure 8:
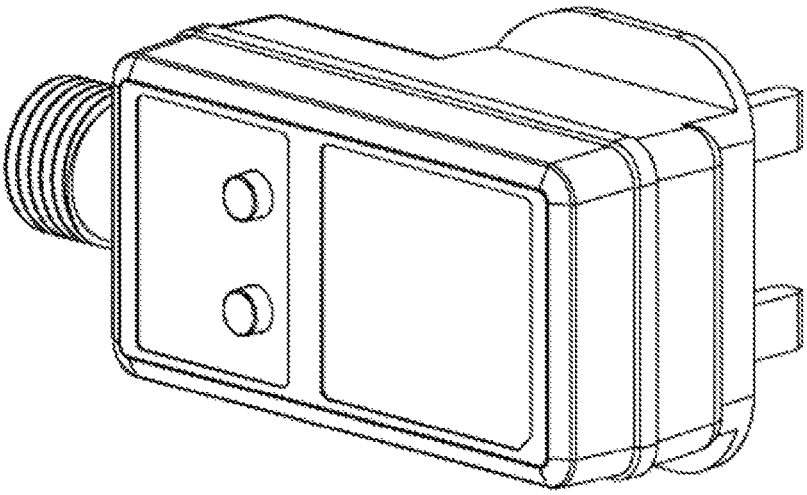
Figure 9:
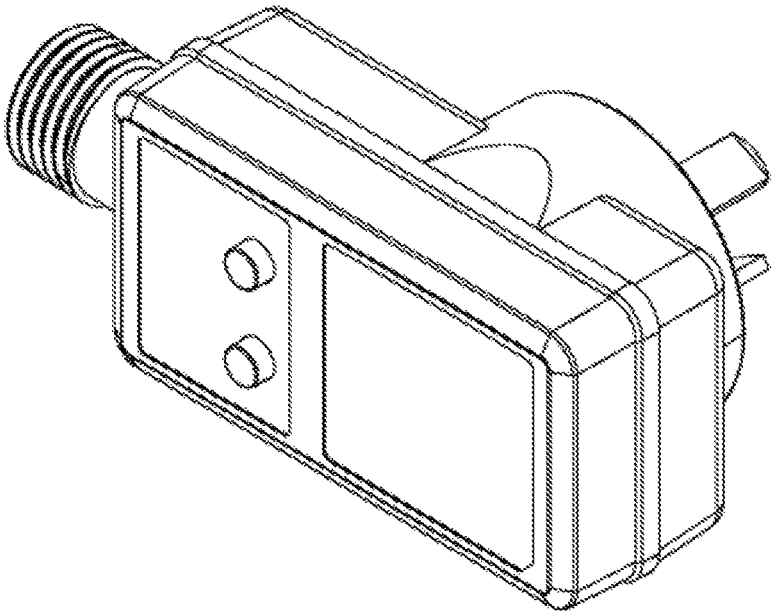
Figure 10:
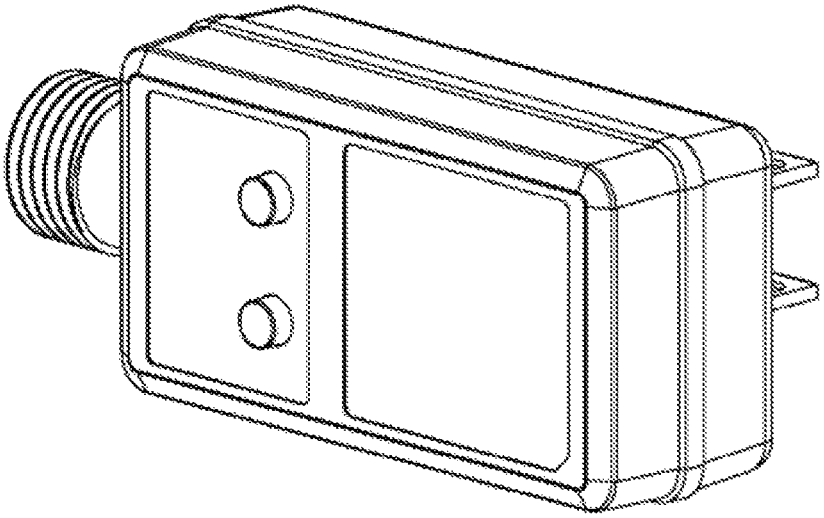
Figure 11:
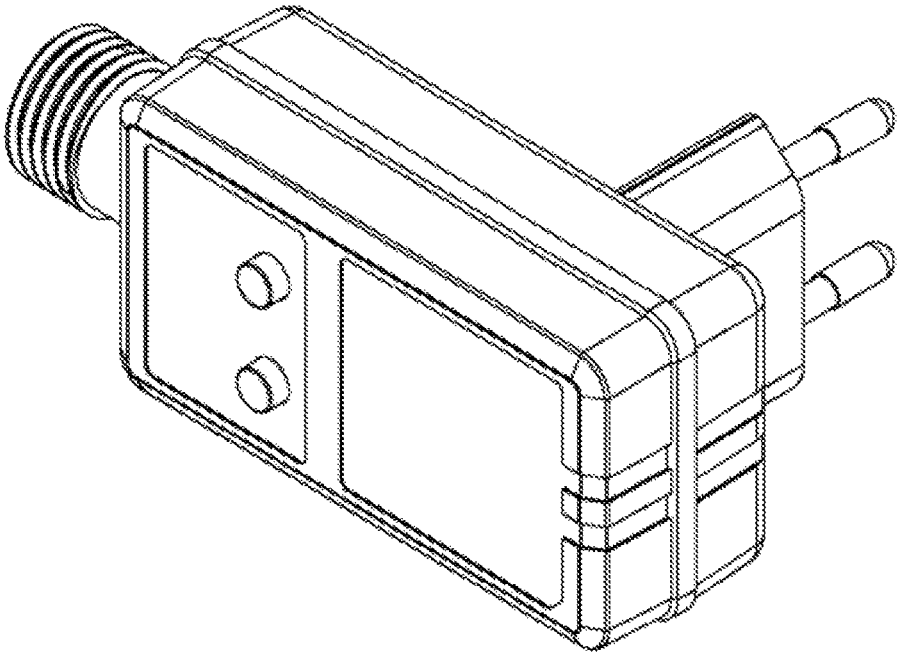
Figure 12:
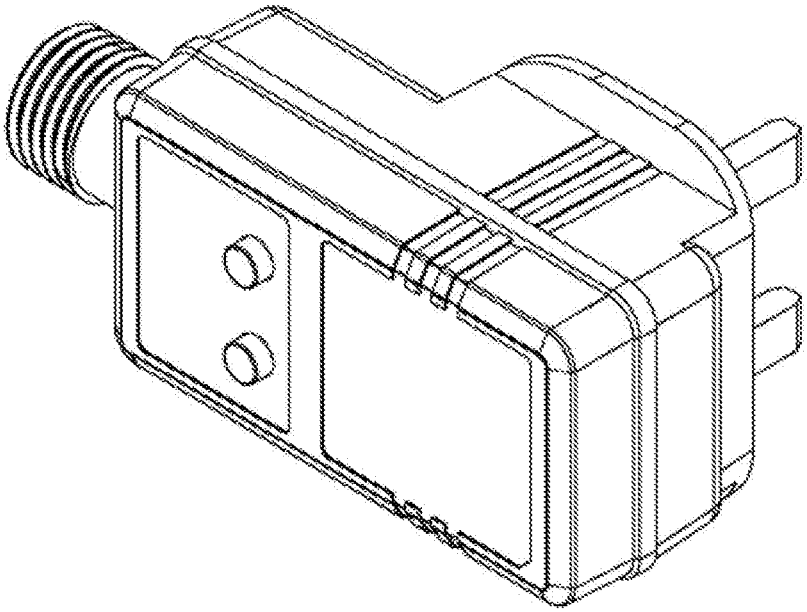
Figure 13:
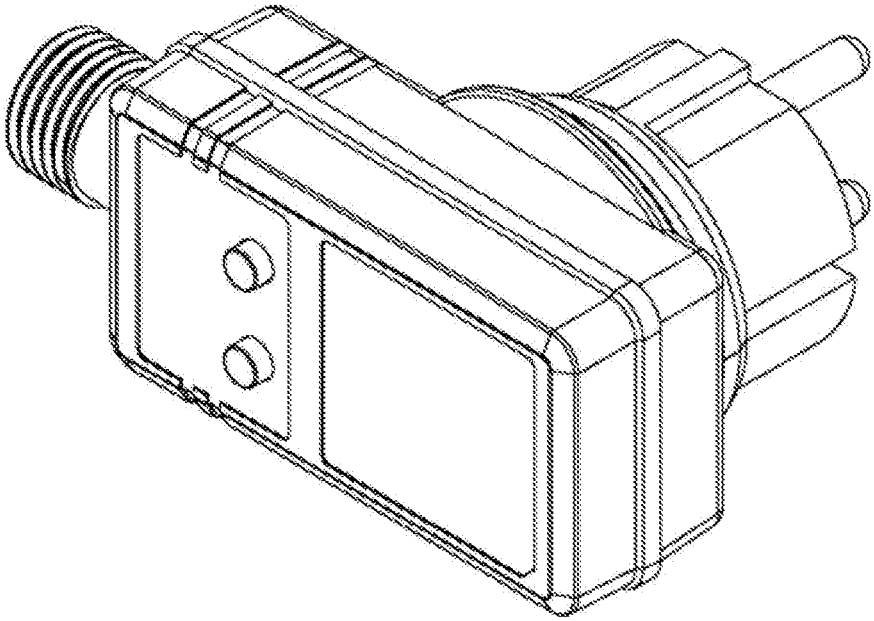
Figure 14:
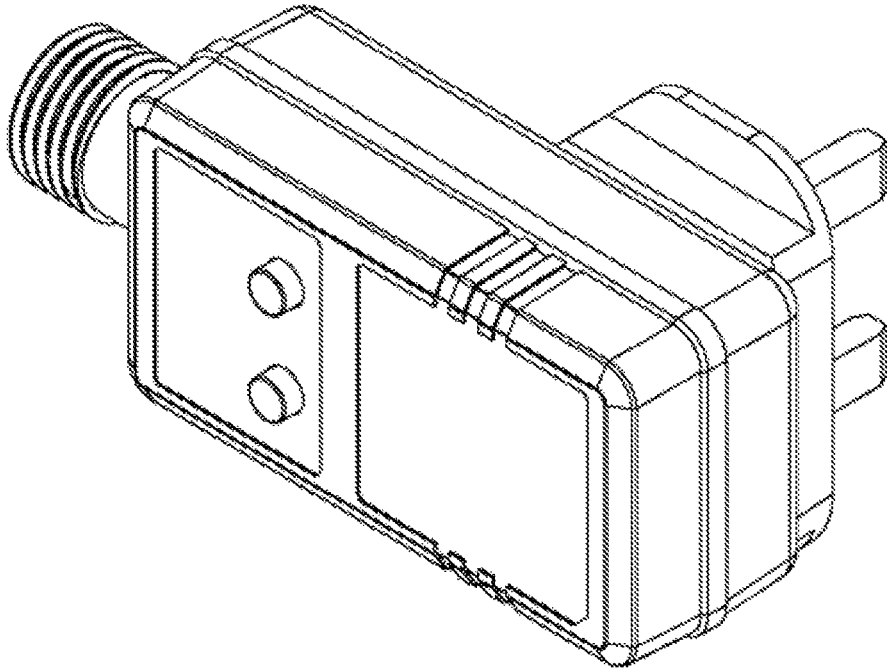
Figure 15:
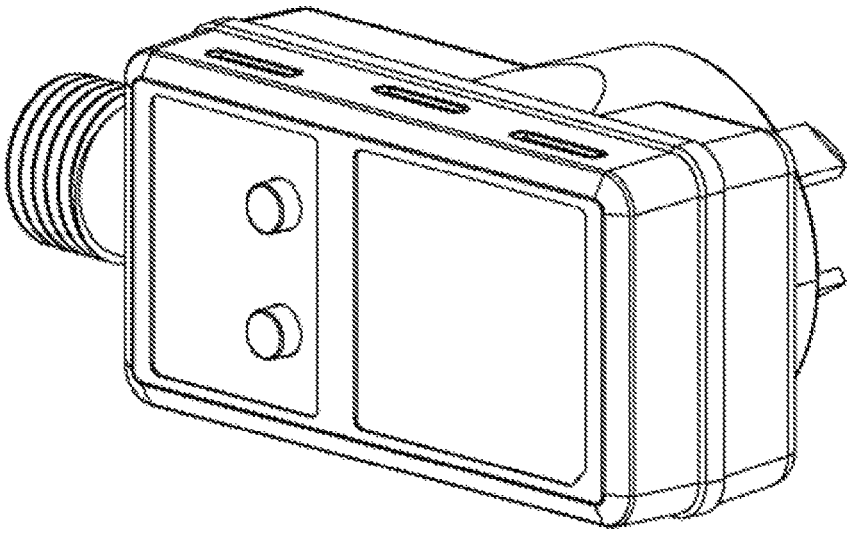

As shown FIGS. 2, 4 and 5, the first mode switching component 4 or the second mode switching component 5 each include a pressing part 8, a deformation part 9 deforming upon being stressed, a support part 10 and a conducting part 11. One end of the pressing part 8 is exposed to air; one end of the support part 10 is supported on the circuit board 3, and the other end of the support part 10 fits with the shell to make the support part 10, and preferably, the support part 10 is clamped between the circuit board 3 and the upper shell 1, thereby forming sealing between the other end of the support part 10 and upper shell 1.

As shown FIGS. 2, 4 and 5, a through hole 10*a* is formed in the support part 10; the other end of the pressing part 8 extends into the through hole 10*a* in the support part 10; one end of the deformation part 9 is connected with the pressing part 8; the deformation part 9 surrounds the pressing part 8; and one end of the deformation part 9 is connected with a peripheral surface of the pressing part 8, and the other end of the deformation part 9 is connected with the other end of the support part 10. The deformation part 9 is in a conical shape; the deformation part 9 on the first mode switching component 4 fits with the tapered hole section 1*b* in the first through hole; and the deformation part 9 on the second mode switching component 5 fits with the tapered hole section 1*b* in the second through hole. Under fit between the deformation part 9 and the tapered hole section 1*b*, the pressing part 8 and the deformation part 9 are easier to reset after the pressing part 8 is pressed.

A waterproof cap (not shown in the figure) is also included, and the waterproof cap is assembled on one end of the pressing part 8 and is in sealing fit with the shell. That is sealing between the waterproof cap and the upper shell is formed to further prevent water from penetrating into the shell.

As shown FIGS. 2, 4 and 5, the conducting part 11 is arranged on the other end of the pressing part; a positive electrode conducting part and a negative electrode conducting part are arranged on the circuit board 3; and the positive electrode conducting part is separated from the negative electrode conducting part. When the pressing part 8 is pressed, the conducting part 11 is driven by the pressing part 8 to move to be fit with the positive electrode conducting part and the negative electrode conducting part, making the circuit board obtain the input signal.

As shown FIGS. 2, 4 and 5, the first mode switching component 4 and the second mode switching component 5 are each provided with an exhaust slot or hole, and preferably, the first mode switching component 4 and the second mode switching component 5 are each provided with the exhaust slot 12 on end faces facing the circuit board. Under fit between the support part 10 and the circuit board 3, the exhaust slot 12 is arranged on one end of the support part 10. As the first mode switching component 4 and the second mode switching component 5 are made of flexible materials integrally, such as silica gel, a closed space is formed between the support part 10 and the circuit board 3 and between the deformation part 9 and the pressing part 8.

Obviously, air exists in the assembly space, and thus, the closed space is communicated with the outside through the exhaust slot 12 to avoid air resistance or negative pressure from being formed in the closed space, which causes the conductive portion 11 to be blocked by the air resistance and cannot fit with the circuit board 3 when operating the pressing portion 8, resulting in operation failure, or causes failure reset of the pressing part 8 when pressed.

Moreover, in order to avoid forming air resistance or negative pressure in the closed space, an exhaust slot 12 or hole may also be formed in the circuit board 3. That is, the exhaust slot or hole is formed in a part of the circuit board 3 that faces the end faces of the first mode switching component 4 and the second mode switching component 5.

The shell in Embodiment 1 has also other structures, as shown in FIGS. 6 to 15.

Embodiment 2

Figure 16:
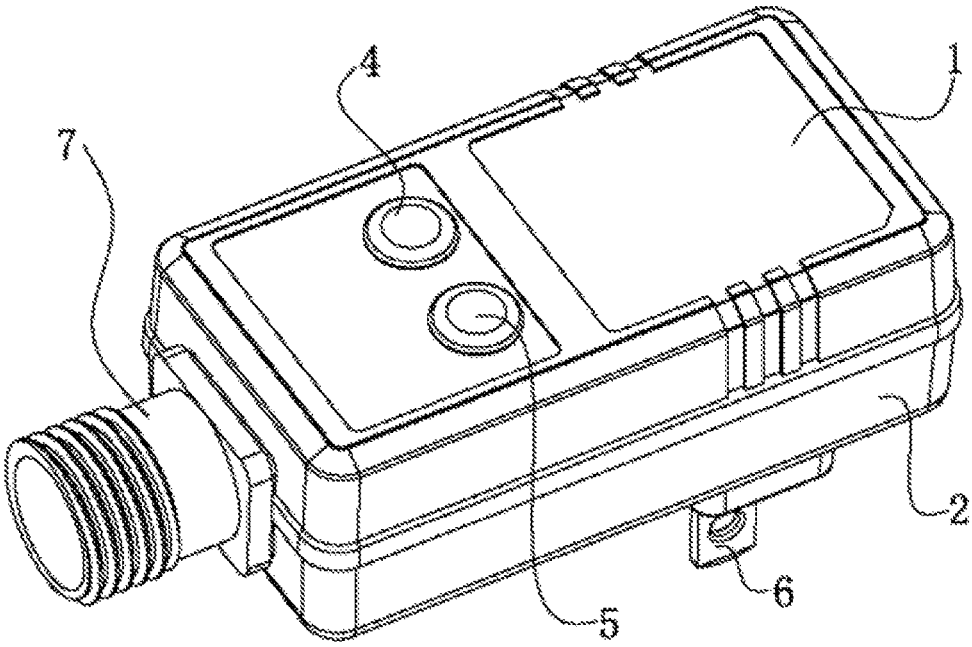
FIG. 16 is a schematic three-dimensional cross-sectional structure diagram of a second multi-button lamp power supply.
Figure 17:
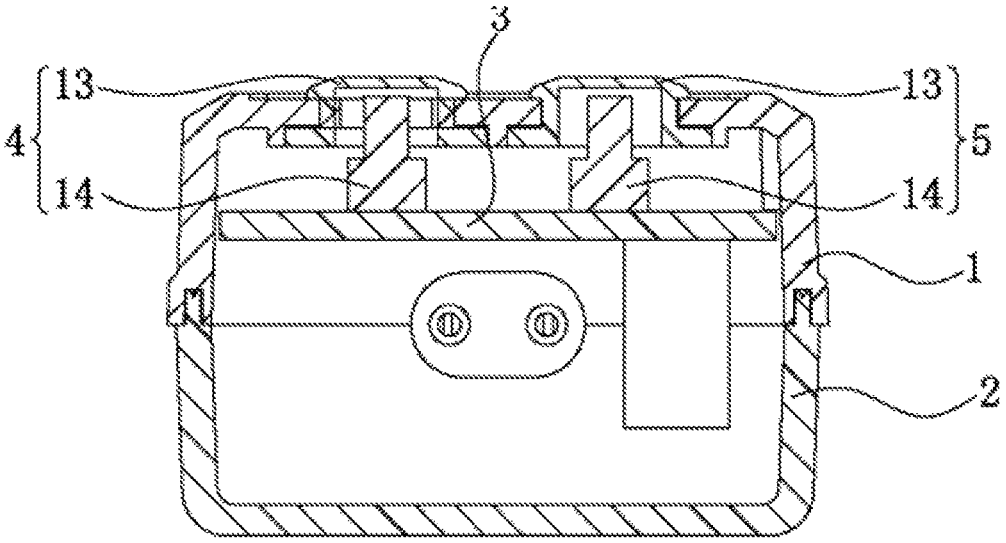
FIG. 17 is a schematic cross-sectional structure diagram of FIG. 16.

As shown in FIGS. 16 and 17, a first mode switching component 4 and a second mode switching component 5 each include a key switch 14. One end of the key switch 14 is welded to a circuit board 3, and the other end of the key switch 14 is a free end; and the free end of the key switch 14 fits with an upper shell. A sealing element 13 is further included, and the sealing element 13 is in sealing fit with the shell; and the other end of the key switch 14 fits with the sealing element 13. The sealing elements 13 are arranged in a first through hole and a second through hole respectively; and the key switch 14 is either in clearance fit or butted fit with the sealing element 13. Preferably, the key switch 14 is in clearance fit with the sealing element 13.

Embodiment 3

In the present embodiment, the structure of a first mode switching component 4 is based on the structure of the first mode switching component in Embodiment 1, and the fit between the first mode switching component and a first through hole is the same as that in Embodiment 1. In the present embodiment, the structure of a second mode switching component 5 is based on the structure of the second mode switching component in Embodiment 2.

Embodiment 4

Figure 18:
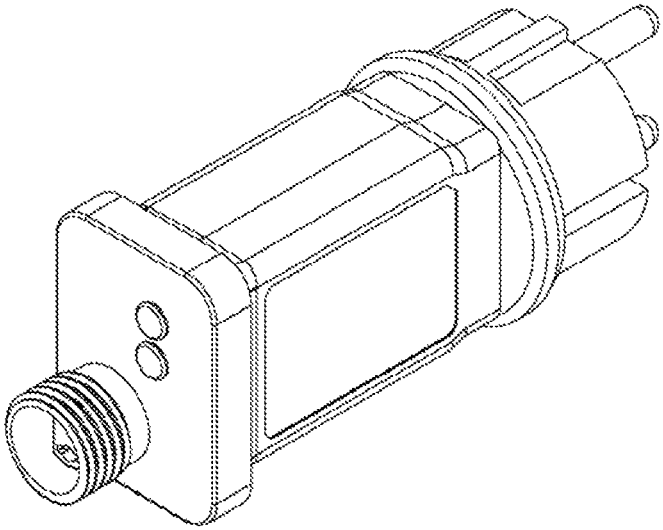
FIG. 18 is a schematic three-dimensional structure diagram of a first elevated lamp power supply.
Figure 19:
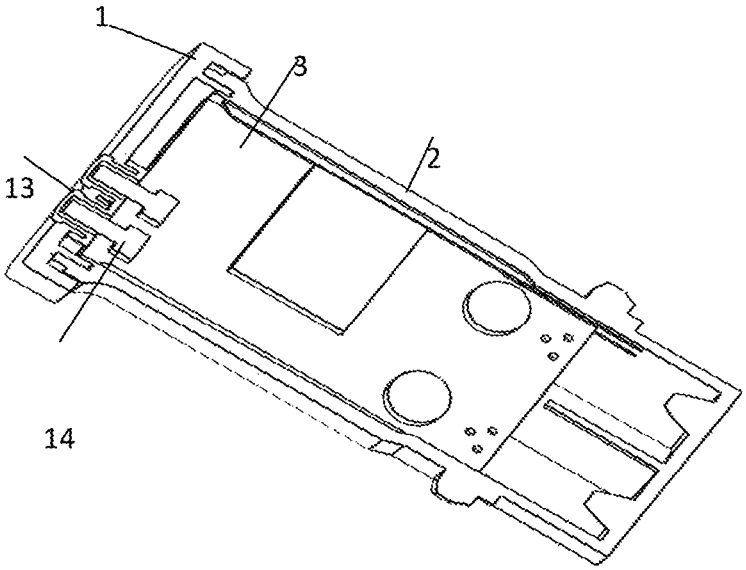
FIG. 19 is a schematic diagram in which a lower shell is hidden on the basis of FIG. 18.
Figure 20:
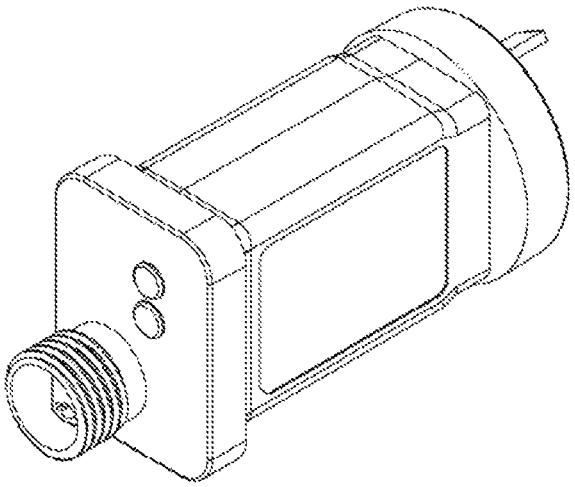
FIG. 20 is a schematic three-dimensional structure diagram of a second elevated lamp power supply.
Figure 21:
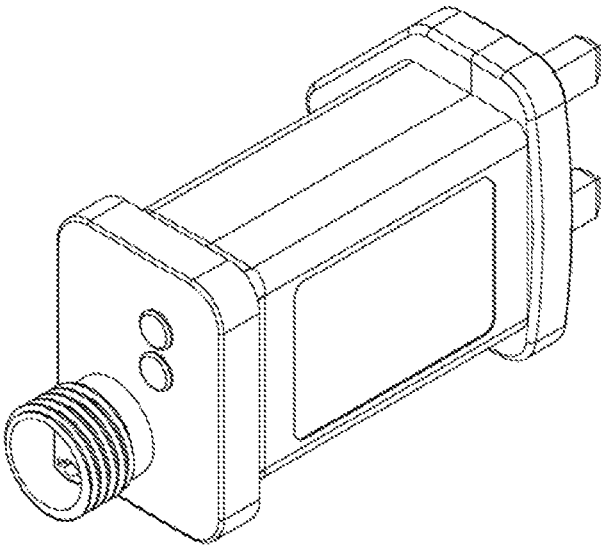
FIG. 21 is a schematic three-dimensional structure diagram of a third elevated lamp power supply.
Figure 22:
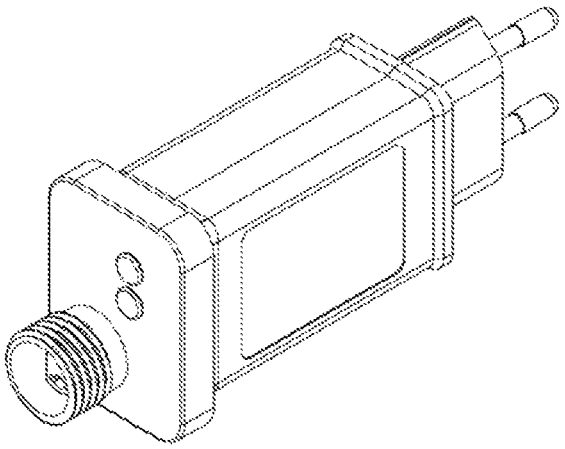
FIG. 22 is a schematic three-dimensional structure diagram of a fourth elevated lamp power supply.
Figure 23:
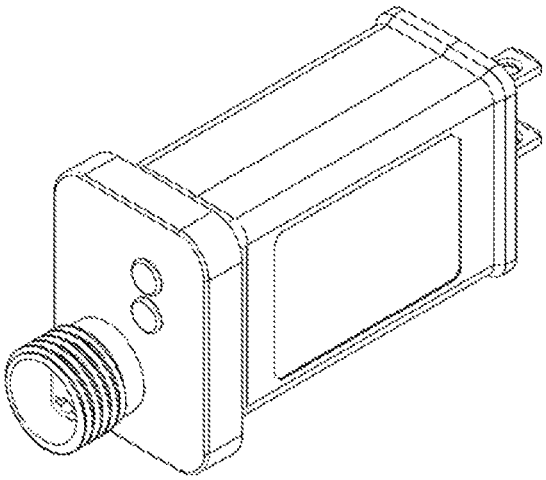
FIG. 23 is a schematic three-dimensional structure diagram of a fifth elevated lamp power supply.
Figure 24:
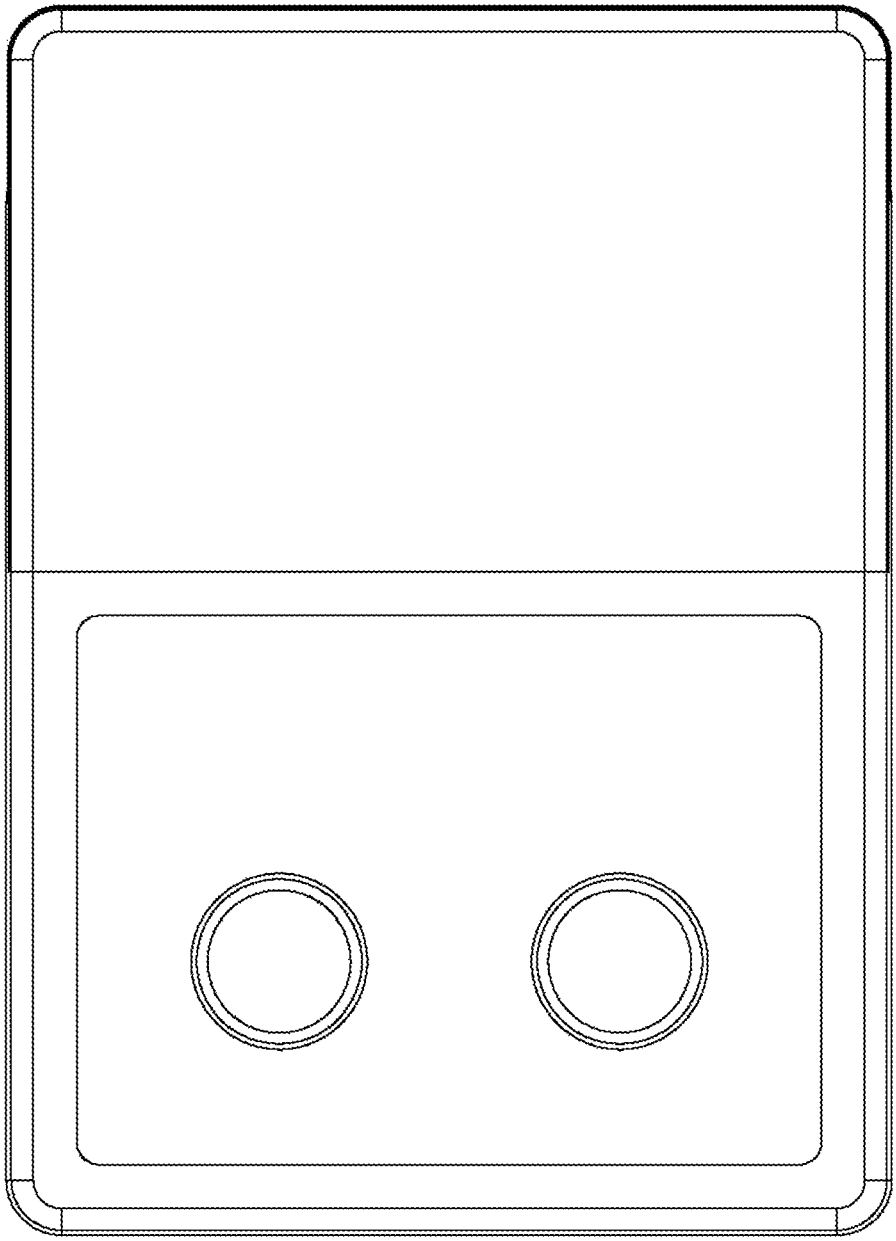
FIG. 24 is a front view of a controller (i.e., an independent controller)
Figure 25:
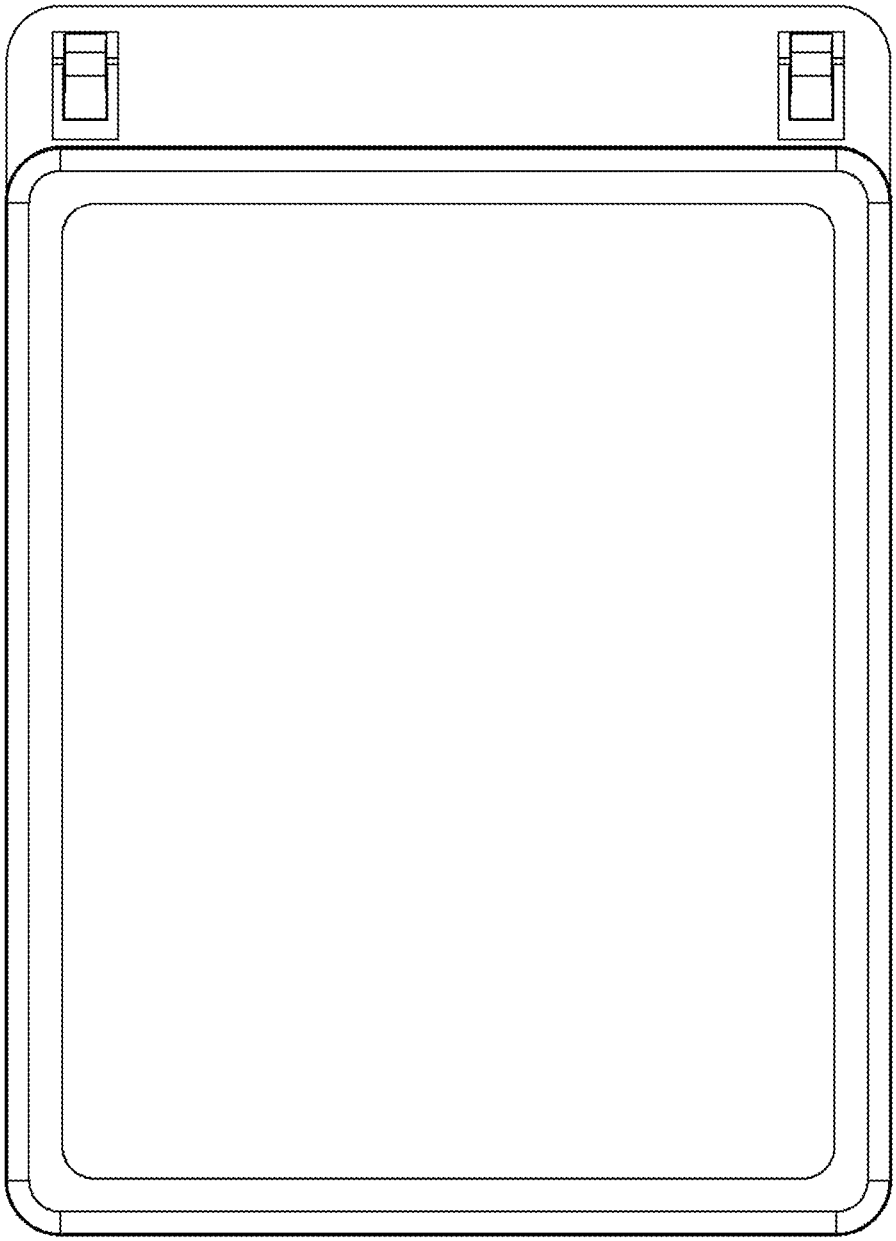
FIG. 25 is a rear view of the controller.
Figure 26:
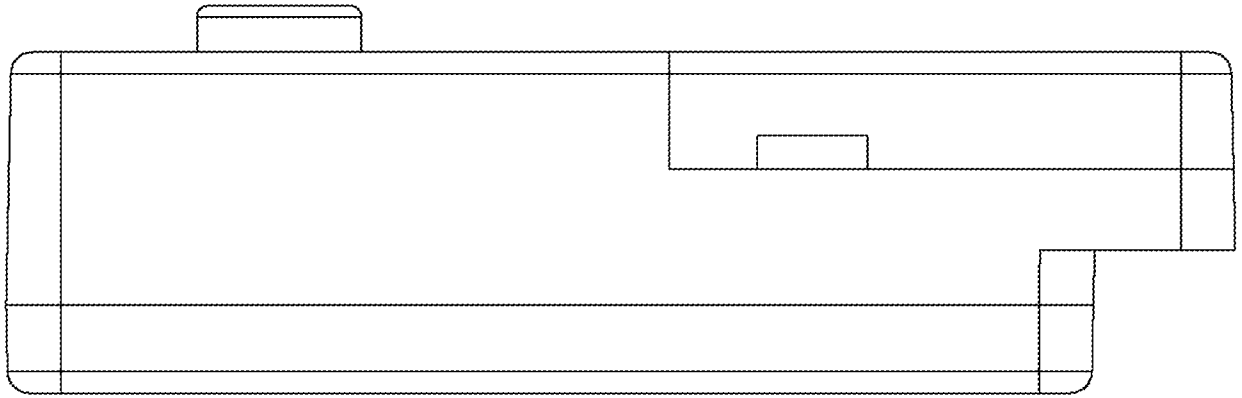
FIG. 26 is a left view of the controller.
Figure 27:
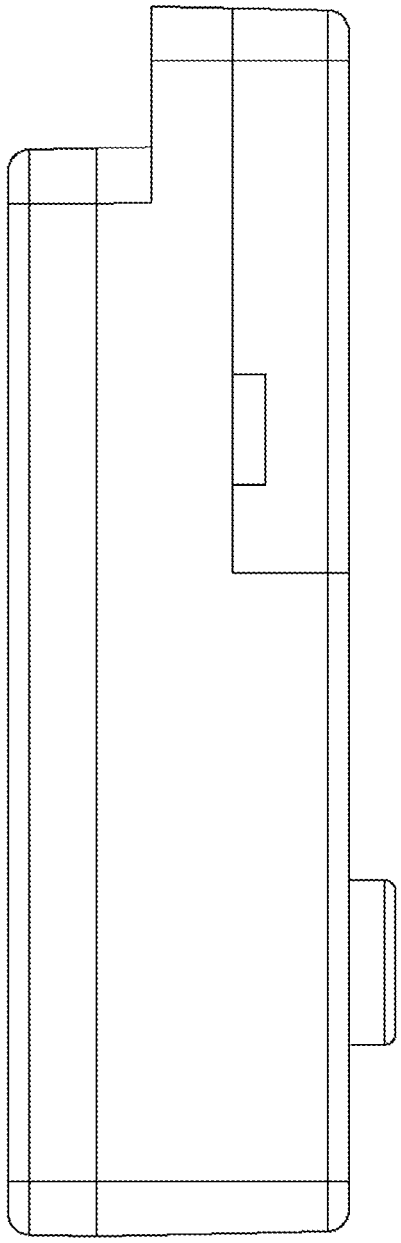
FIG. 27 is a right view of the controller.
Figure 28:
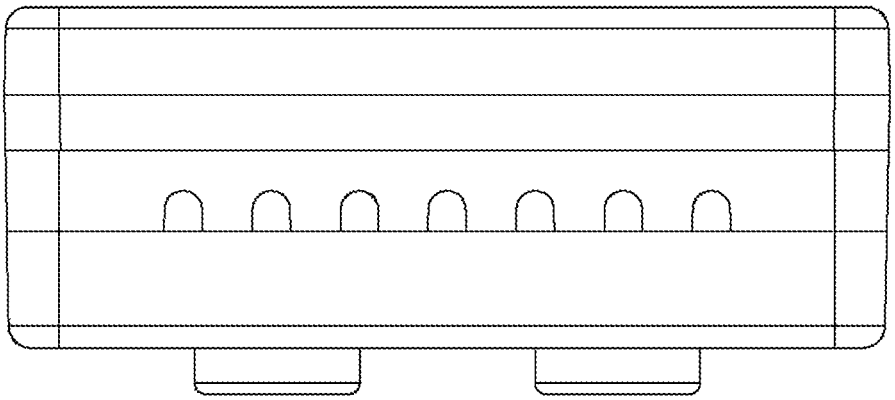
FIG. 28 is a top view of the controller.
Figure 29:
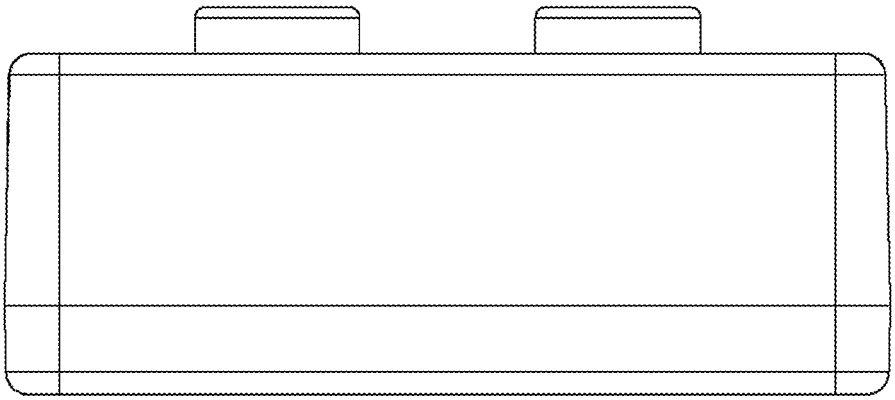
FIG. 29 is an upward view of the controller.
Figure 30:
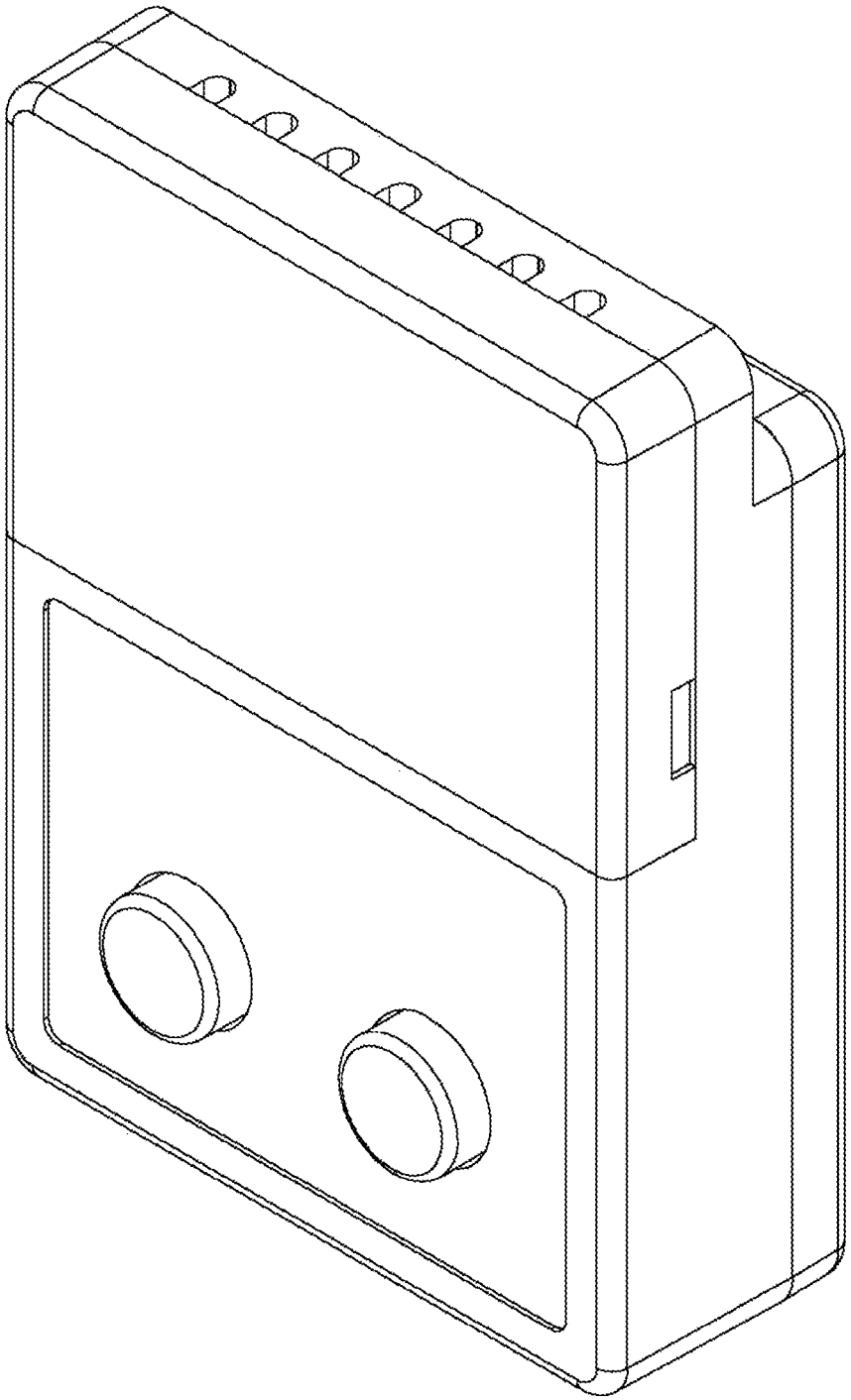
FIG. 30 is a stereogram of the controller.

As shown in FIGS. 18 to 19, the lamp power supply is an elevated lamp power supply, and an input end of a shell is parallel to an output end of the shell in an axial direction. A circuit board 3 is inserted into a lower shell in a direction parallel to an axial direction of the lower shell, a first mode switching component and a second mode switching component each include a key switch 14. One end of the key switch 14 is welded to the circuit board 3, and the other end of the key switch 14 is a free end; the key switch 14 is provided with a pin welded to the circuit board 3, and is welded to the circuit board 3 through the pin; and an included angle of 90 degrees is formed between an axial direction of the free end of the key switch 14 and the pin. Sealing elements 13 are further included and the sealing elements are in sealing fit with the shell; and the other end of the key switch 14 fits with the sealing part 13. Sealing elements 13 are arranged in a first through hole and a second through hole respectively; and the key switch 14 is either in clearance fit or butted fit with the sealing element 13. Preferably, the key switch 14 is in clearance fit with the sealing element 13.

The appearances of the rest elevated power supplies are shown as FIGS. 20 to 23.

Based on the embodiments, the utility model also provides a controller. Only the control circuit is arranged on the circuit board, and the power supply required by the controller is supplied by the external power supply processing circuit. The orthographic views of the appearance of the controller are shown as FIGS. 24 to 29, and FIG. 30 is the three-dimensional view of the controller.

The invention claimed is:

1. A multi-button lamp power supply or controller, comprising a shell and a circuit board arranged in the shell, and further comprising:

a first mode switching component, wherein one end of the first mode switching component fits with the shell, and an other end of the first mode switching component is positioned inside the shell and fits with the circuit board; and a second mode switching component, wherein one end of the second mode switching component fits with the shell, and an other end of the second mode switching component is positioned inside the shell and fits with the circuit board; and an exhaust slot of a plurality of exhaust slots;

wherein the first mode switching component and the second mode switching component each comprise:

a pressing part with one end of the pressing part exposed to air;

a deformation part deforming upon being stressed;

a support part, wherein one end of the support part is supported on the circuit board, and an other end of the support part fits with the shell, making the support part fit with the shell; a through hole is formed in the support part; an other end of the pressing part extends into the through hole in the support part; and one end of the deformation part is connected with the pressing part, and an other end of the deformation part is connected with the other end of the support part;

a conducting part arranged on the other end of the pressing part; and a closed space is formed between the support part and the circuit board and between the deformation part and the pressing part;

wherein the exhaust slot of the plurality of exhaust slots is formed in a part of the circuit board that faces a plurality of end faces of the first mode switching component and the second mode switching component so the closed space is communicated outside of the closed spaced through the exhaust slot to avoid air resistance or negative pressure being formed in the closed spaced, which causes the conducting part to be blocked by the air resistance and cannot fit well with the circuit board when operating the pressing part, resulting in operation failure or causes failure reset of the pressing part when pressed.

2. The multi-button lamp power supply or controller according to claim 1, wherein the plurality of exhaust slots further comprises exhaust slots formed in the first mode switching component and the second mode switching component.

3. The multi-button lamp power supply or controller according to claim 1, wherein the deformation part is in a conical shape.

4. The multi-button lamp power supply or controller according to claim 1, wherein the shell comprises an upper shell and a lower shell, wherein the lower shell is fixed to the upper shell; a first through hole and a second through hole are formed in the upper shell; one end of the first mode switching component passes through the first through hole and is exposed outside the shell; and one end of the second mode switching component passes through the second through hole and is exposed outside the shell.

5. The multi-button lamp power supply or controller according to claim 4, further comprising a waterproof cap, wherein the waterproof cap is assembled on one end of the pressing part and is in a sealing fit with the shell.

6. The multi-button lamp power supply or controller according to claim 4, wherein a first annular accommodating part and a second annular accommodating part are arranged on an inner surface of the upper shell that faces the lower shell; the first annular accommodating part is positioned around the first through hole, and the second annular accommodating part is positioned around the second through hole; and one part of the first mode switching component fits in the first annular accommodating part, and one part of the second mode switching component fits in the second annular accommodating part.

7. The multi-button lamp power supply or controller according to claim 1, wherein the first mode switching component and the second mode switching component each comprise a key switch; and one end of the key switch is welded to the circuit board, and an other end of the key switch is a free end.

8. The multi-button lamp power supply or controller according to claim 7, wherein the plurality of exhaust slots further comprises exhaust slots formed in the first mode switching component and the second mode switching component.

9. The multi-button lamp power supply or controller according to claim 1, wherein the deformation part surrounds the pressing part.

* * * * *